United States Patent [19]

Haines

[11] 4,020,819

[45] May 3, 1977

[54] VARIABLE FORCE BOW

[76] Inventor: James Ronald Haines, 1217 Tonti St., LaSalle, Ill. 61301

[22] Filed: Nov. 24, 1975

[21] Appl. No.: 634,636

[52] U.S. Cl. ..... 124/23 R; 124/86; 124/90

[51] Int. Cl.[2] ..... F41B 5/00

[58] Field of Search ..... 124/23 R, 24 R, 80–92

[56] References Cited

UNITED STATES PATENTS

| | | | |
|---|---|---|---|
| 1,885,962 | 11/1932 | Swenson et al. | 124/30 A |
| 3,812,835 | 5/1974 | Smith | 124/24 R |

*Primary Examiner*—Richard C. Pinkham
*Assistant Examiner*—William R. Browne

[57] ABSTRACT

A bow having a variable tension bowstring including one or more movable connecting points for the bowstring which points travel along the bow limbs from more central positions toward the limb tips as the bowstring is drawn, whereby the "drawing force," required to draw the bowstring to a fully extended position, gradually increases to a peak and then decreases and stabilizes so that the drawing force required to maintain the bowstring fully drawn is much less than the force at its peak. A pair of rollers are coupled to the bowstring and mounted for movement along the bow limbs. The rollers are connected by a member for keeping the distance between the rollers constant while the rollers ride along the limbs as a bowstring is drawn.

6 Claims, 10 Drawing Figures

VARIABLE FORCE BOW

BACKGROUND OF THE INVENTION

The present invention relates to archery bows for uses such as hunting or target shooting and more particularly to an improved archery bow having a tensioning device to vary the force required to bend the bow during the time when the bow is in use or being drawn.

Archery bows are normally constructed to provide an elongated curvilinear body having a midportion of increased cross section and tapering towards opposite ends to terminate in tip portions which are interconnected by the bowstring. The bow is usually made of a flexible material and the tapered configuration adds to the flexibility of the bow when the bowstring is tensioned by the placement and drawing of an arrow on the string.

For greater accuracy in aiming the arrow it would be desirable to lessen the tension required to hold the bowstring completely drawn for hunting or target shooting conditions. Thus, under those circumstances, lessening the drawn tension would help steady the archer's arm when the bow is aimed, notwithstanding the large forces necessary to obtain adequate arrow propelling speed. It is also desirable to apply the propelling force to the arrow in a smooth manner thus eliminating the application of impact forces which could upset the aim and direction of the arrow.

It is known to adjustably mount the bowstring so that its position can be varied at the tip ends of the bow to thereby increase or decrease the effective length of the bow adding more stiffness to the bow as the string is moved towards the center of the bow and increasing the flexibility of the bow as the string is moved further outwardly towards the tip ends. However, this arrangement is unsatisfactory in that it foreshortens the arrow draw, in that only a limited number of positions are available to vary the tension force required to bend the bow, and in that only static settings are attainable.

Similarly, a limitation in conventional bow design is that the energy which may be stored in the limbs is limited by the archer's muscular ability to sustain a bow at full draw.

Prior art bows also have constructions whereby the power of a bow may be dynamically adjusted by various means such as springs, cams, eccentrics and the like, and such bows are called "compound" bows. However, most of the latter devices are awkward and complicated, and the usefulness and accuracy of such bows has been handicapped to some extent by such limitations.

OBJECTS OF THE INVENTION

It is therefore a primary object of this invention to provide a bow of new and novel construction.

A further object of this invention is to provide a bow construction which includes a novel means for adjusting the bow so that the force required to draw it may be suited to the archer's strength or preference.

Still another object of this invention is to provide a novel bow wherein the means provided for adjusting the drawing force requirements does not interfere with the aiming or shooting of an arrow.

It is an additional object to provide a bow which requires a lesser pull force at full draw than at an intermediate draw position, so that the maximum force applied by the archer to the bowstring will not need to be sustained by the archer's arms in order to hold the string fully drawn.

Another object is to provide a bow having force controlling devices on the limbs thereof which transmit the force applied to the bowstring to different parts of the limbs as the bowstring is drawn.

These and other objects and advantages of this invention will be apparent from the following description and claims.

SUMMARY OF THE INVENTION

The present invention provides an archery bow which is equipped with one or more movable mounting points for the bowstring. The mounting points are on followers supported on the bow limbs and are arranged to move from a more central position toward the bow limb tips as the bowstring is drawn, and in the opposite direction when the string is released. The amount and direction of movement are controlled by guides so that the force required to draw the bow builds to a peak and then drops to a lesser force required to hold the fully drawn bow.

Three embodiments are disclosed—one includes a pair of legs supported on and generally normal to the handle or body of the bow. The legs extend toward the bowstring and provide pivot points at their extended ends for connecting radius arms for guiding rollers on the bow limbs, whereby the rollers are caused to follow an arc as they move outwardly toward the limb tips. The location of the pivot points can be changed in order to adjust the drawing force to the archer's preference. At each limb tip there is a pulley mounted so that in this embodiment the bowstring extends between bow tips across the pulleys, and then parallel to the limbs of the bow to the rollers.

In the second embodiment the bowstring is connected to the limbs of the bow at the tips in a conventional manner and rollers ride upon the bow limbs as hereinbefore described. The directional control of the rollers is by means of three control cables. One control cable is in the position of a chord intermediately placed across the mouth of the bow between the string and bow handle. Said chordal cable is attached at each end to a roller. The other two control cables are each attached at one end to a roller and at the other end to the bowstring, so that when the bow is drawn, the latter two cables pull the rollers from a more central position toward the limb tips.

In the third embodiment the bowstring is connected between a roller which travels along one limb and a pulley connected to the tip of the opposite limb. There is only one roller in this embodiment, and the bowstring is strung from the roller to a first pulley at the nearest limb tip, then to a second pulley at the opposite limb tip, then back to the first pulley (which contains two grooves), and then back to the roller. In addition to the bowstring, there is a coacting control cable connected at one end to the roller and at its other end to the opposite limb tip, such that as the bowstring is drawn, the limbs bend simultaneously under the influence of the roller and cable. Thus the third embodiment offers a mechanically simplified alternative.

The device of the present invention will be best understood by reference to the following detailed description in connection with the appended drawings forming a part thereof.

BRIEF DESCRIPTION OF THE DRAWINGS

The accompanying drawings illustrate a preferred embodiment of the invention in which.

DETAILED DESCRIPTION OF THE DRAWINGS

Uniform numbering is used for elements common to the Figures for the various embodiments.

Figure 4:
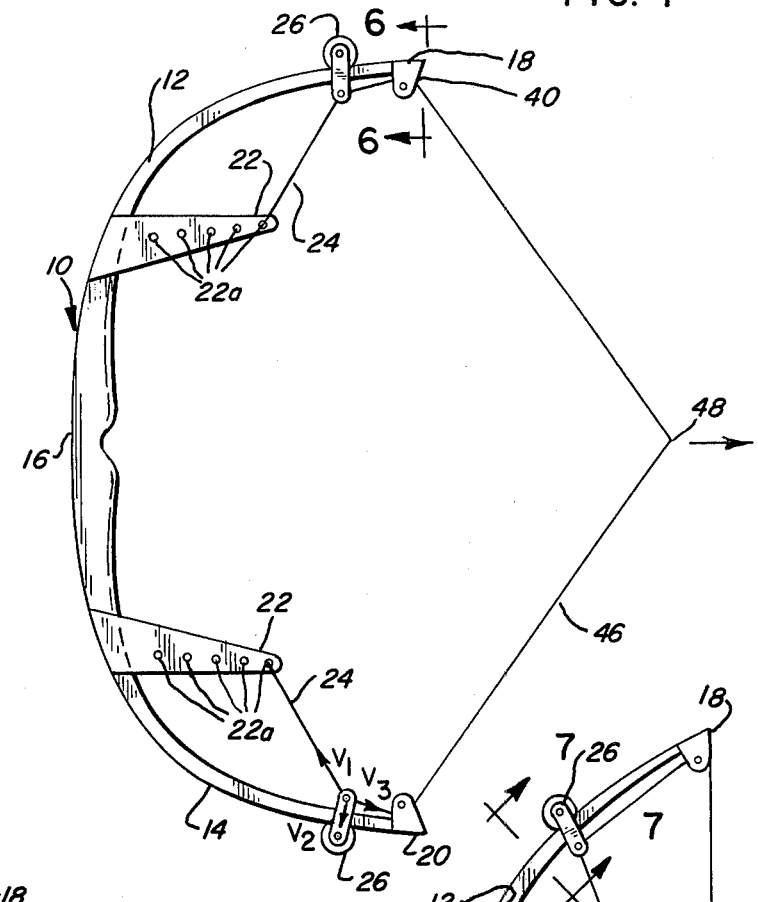
FIG. 4 is a side elevational view of the archery bow of FIG. 3 shown in a fully drawn position.
Figure 3:
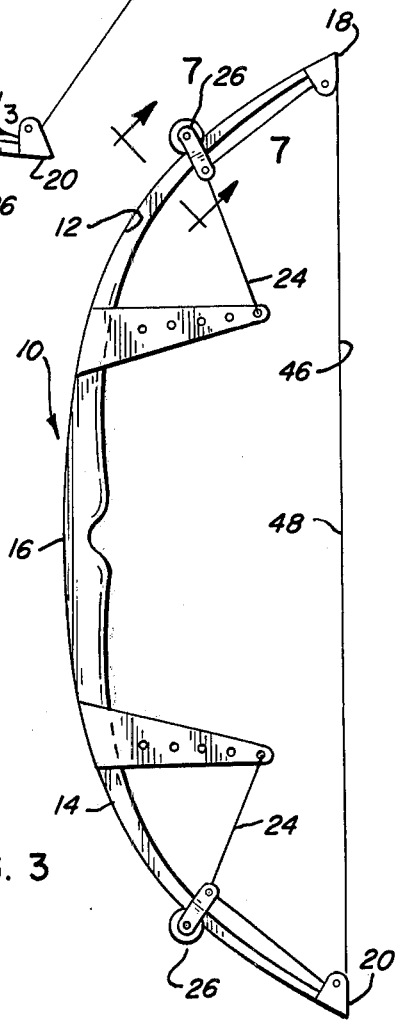
FIG. 3 is a side elevational view of an alternate form of an archery bow shown in an at rest position.

With reference to the drawings, the preferred embodiment of an archery bow 10 constructed in accordance with the present invention is shown in FIGS. 3 and 4, comprising substantially identical elongated limbs 12 and 14 which are of curvilinear shape and provide a substantially rigid midportion of increased cross section 16. From this midportion 16 or handle the bow limbs 12 and 14 are tapered in opposite directions to tip portions 18 and 20, respectively. The tapered configurations add to the flexibility of the bow and distribute bending stresses along its length.

Figure 7:
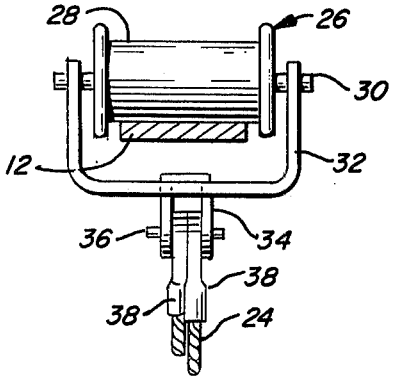
FIG. 7 is an enlarged fragmentary view taken along line 7—7 of FIG. 3.

At the juncture of body portions 12 and 14 with handle 16 are legs 22 extending inwardly (toward the bowstring). Each of said legs 22 has a plurality of adjustment holes **22*a* disposed along an inwardly extending line. Connected to holes 22*a* are cables 24 which extend toward limbs 12 and 14 and are connected to rollers 26, best shown in FIG. 7. Each roller 26 has a roller spool 28 carried on a roller pin 30 held by a U-shaped frame 32. The bight of frame 32 carries a clevis 34 and a clevis pin 36. The clevis pin 36 is connected to the end of the cable 24 by means of a crimp connector 38. As shown in FIG. 7, the roller spool 28 is adapted to ride along the bow 10 limb portions 12 and 14**, and can roll to and fro.

Figure 6:
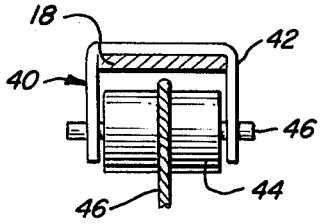
FIG. 6 is an enlarged fragmentary view taken along line 6—6 of FIG. 4.

At the tips 18 and 20 of the bow 10, shown in FIGS. 3 and 4, are pulley supports 40 which are shown in enlarged detail in FIG. 6. The pulley supports consist of U-shaped brackets 42 which are attached to the bow tips 18 and 20. Carried on each of the brackets 42 is a pulley wheel 44 having a support pin 46, whereby pulley wheel 44 may rotate within the confines of bracket 42. Also shown in FIG. 6 is a portion of bowstring 46 which is strung between clevis 34 on one roller 26, which is carried on limb 12, to corresponding clevis 34 on another roller 26 which is carried on limb 14. The bowstring 46 has crimp connectors 38, as shown in FIG. 7, which connect clevises 34 to the bowstring 46. The bowstring 46 is strung from clevis pin 36 on roller 26 on limb 12 over pulley wheel 44 at tip 18 to pulley wheel 44 at tip 20, and finally to clevis pin 36 on roller 26 on limb 14.

Figure 1:
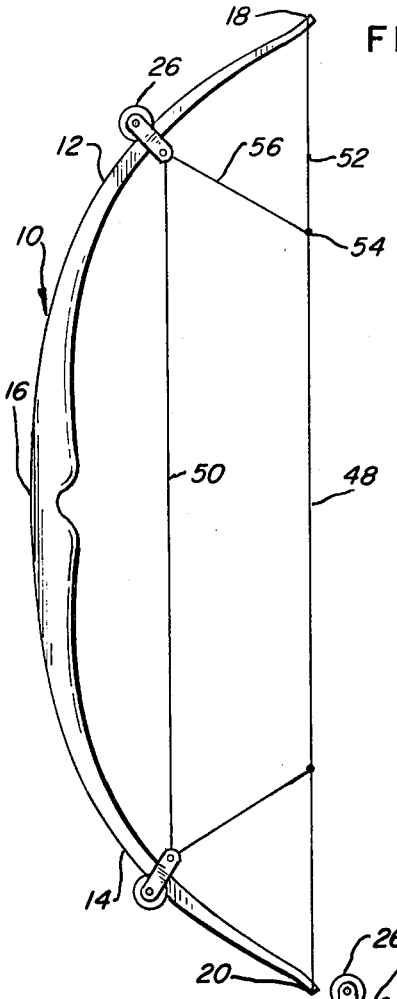
FIG. 1 is a side elevational view of one form of the archery bow of the present invention shown in an at rest position.
Figure 2:
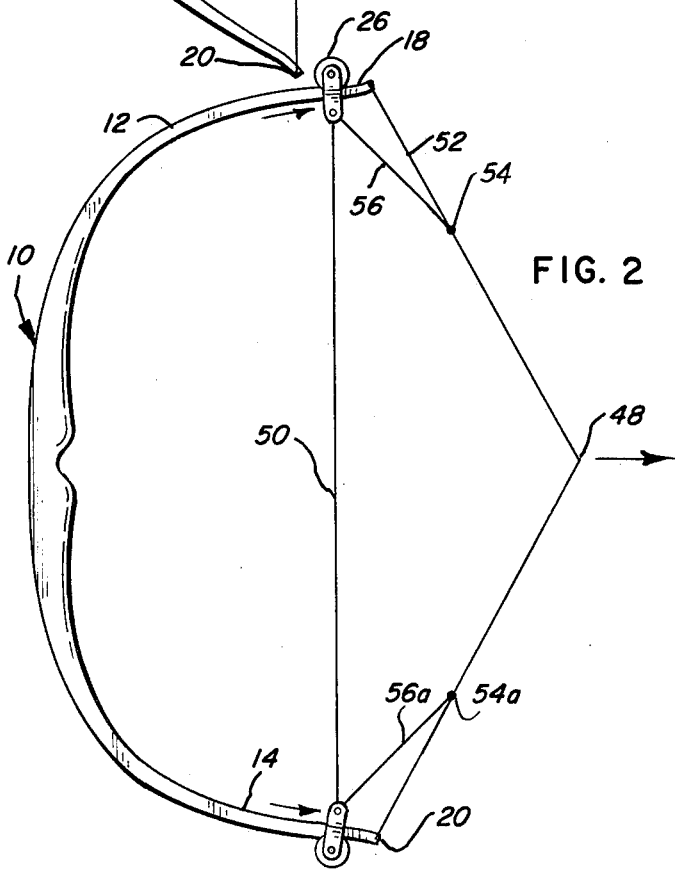
FIG. 2 is a side elevational view of the archery bow of FIG. 1 shown in a fully drawn position.

The bow 10 shown in FIGS. 1 and 2 is an alternate form. There is a cross cable 50 which is mounted offset from the plane of the bow so as to not interfere with the aiming, alignment or shooting of an arrow. To obtain the offset, the attachment by clevises 34, shown in FIG. 7, can be altered by shifting the clevises sideways. Cable 50 has crimp connectors 38 at each end which connect to clevis pins 36 as already described. Cable 50 is inextensible and acts via the rollers 26 to restrain outward extension of bow limbs 12 and 14. The bowstring 52 is connected to the bow 10 at tips 18 and 20. Intermediate the bowstring nocking point 48 and tip 18 is a connection point 54 for an auxiliary cable 56 which extends from point 54 on the bowstring 52 to clevis 34 on roller 26, where it is attached by means of a crimp connector 38. Similarly, between nocking point 48 and tip 20 there is a connecting point **54*a* on bowstring 52 for an auxiliary cable 56*a* which extends from point 54*a* to clevis 34 on roller 26 which is carried on limb 14**.

Figure 8:
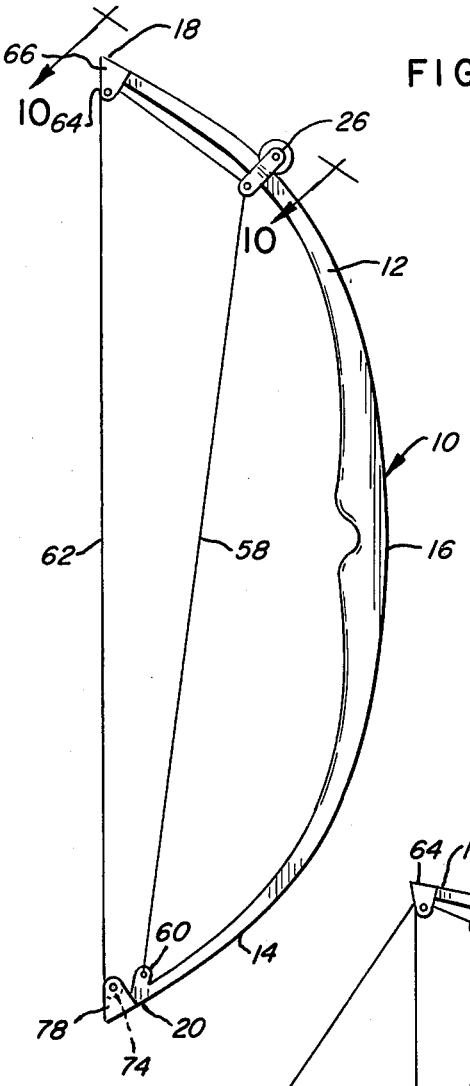
FIG. 8 is a side elevational view of an alternate form of an archery bow shown in an at rest position.
Figure 10:
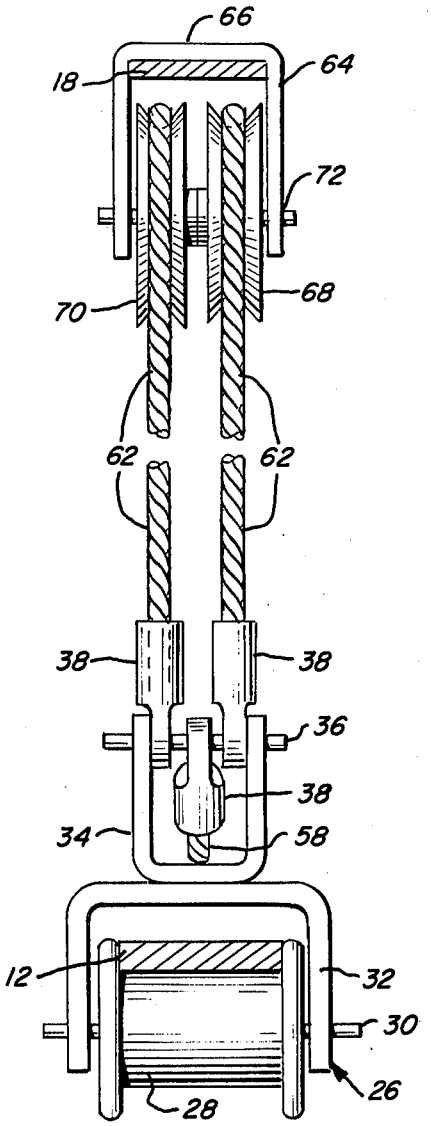
FIG. 10 is an enlarged fragmentary view taken along lines 10–10 of FIG. 8.
Figure 9:
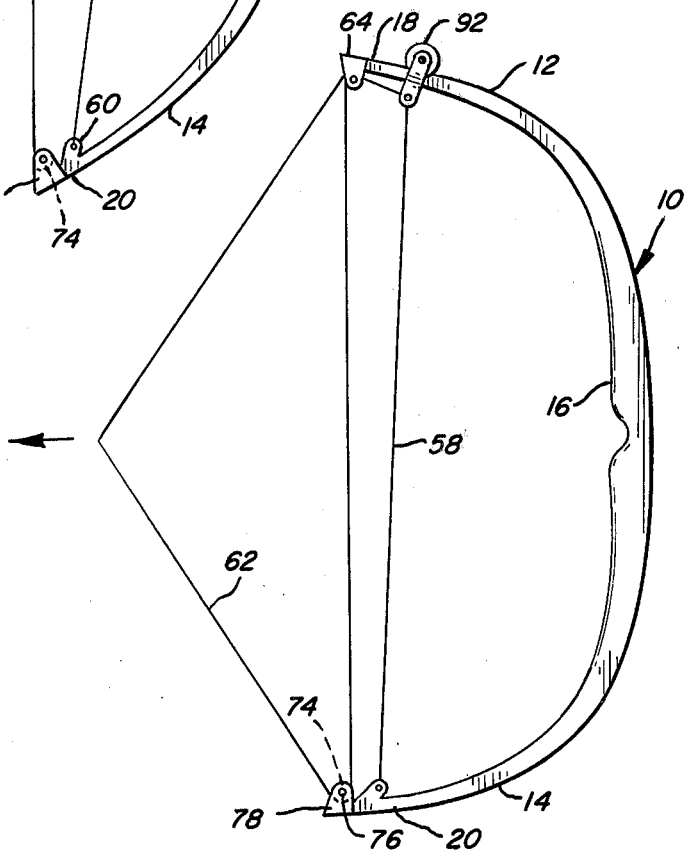
FIG. 9 is a side elevational view of the archery bow of FIG. 8 shown in a fully drawn position.

The bow shown in FIGS. 8 and 9 is an alternate form, in which there is only one roller 26. The roller 26, on limb 12, is connected to a cable 58 at one end by a crimp connector 38, see FIG. 10, and at the other end to an attachment point 60 on limb 14. The bowstring 62 is strung from the roller 26 through a groove 68 of pulley 64 carried on axle 72 of bracket 66 at limb tip 18, to pulley wheel 74 mounted on axle 76 supported on a yoke-shaped fixture 78 on limb tip 20, through a groove 70 of pulley 64 and back to roller 26. Pulley wheel 74 may be disposed at an angle to the plane of bow 10. The construction of the roller 26 is identical to that disclosed in connection with FIGS. 1, 2, 3 and 4, and described and shown in FIG. 7, except that clevis 34 is wider so that three cables can be connected to clevis pin 36, as shown in FIG. 10.

OPERATION OF BOW

In operation the bow in its rest position, FIG. 3, is drawn at the nocking point 48 on bowstring 46 and when fully drawn attains the position shown in FIG. 4. During the drawing the rollers 26 move from a more central location toward the ends of limbs 12 and 14. Because cables 24 are inextensible, rollers 26 follow a generally arcuate path which draws tips 18 and 20 toward one another. The energy transmitted to limbs 12 and 14 during drawing is largely contained in cables 24 when the bow 10 is fully drawn, FIG. 4.

When the alternate form of bow in FIGS. 1 and 2 is drawn, the force transmitted along cables 56 and **56*a* pulls rollers 26 along limbs 12 and 14 toward tips 18 and 20, respectively, and the energy is contained by cable 50**.

Figure 5:
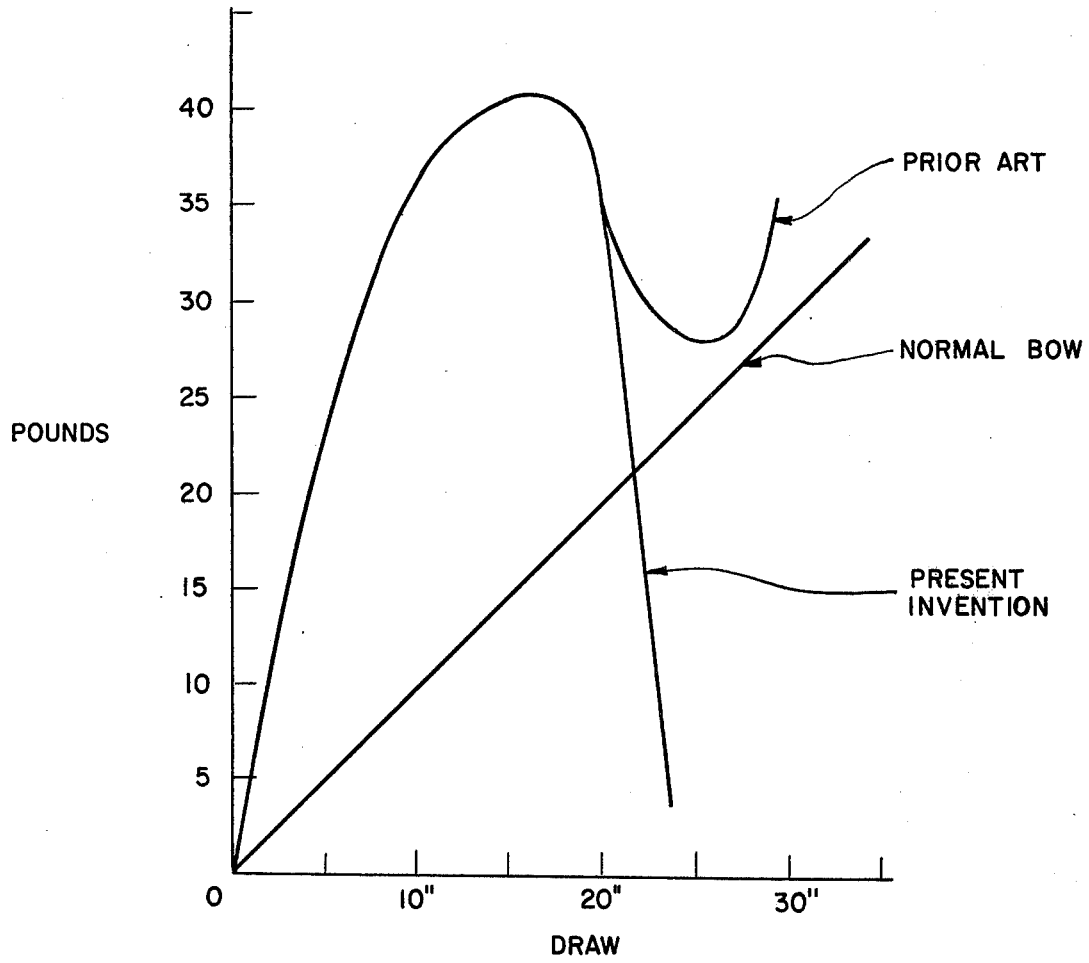
FIG. 5 is a graph depicting the force versus draw relationships of various bows.

FIG. 5 shows a graph which exemplifies the drawing force on the ordinate axis, in relationship to the distance of the draw on the abscissa.

A conventional bow operates like a spring and thus follows Hooke's Law. Consequently, the curve for a normal bow is a sloping line wherein the force required steadily increases with the distance of the draw. The compound bows in the prior art recognized the difficulties of such a conventional bow and attempted to lessen the fully drawn load by means of leverage altering devices applied to the limbs of the bow to produce a force-distance curve similar to that shown in FIG. 5 and labeled "prior art."

Although the said leverageable prior art bows achieved some decrease in the force required for full draw, the present invention achieves a much greater differential in the force required for obtaining and maintaining a full draw as compared to the peak drawing force, as also illustrated in FIG. 5. This improvement is one of the results from the fact that the limbs of the bow in the present invention are restrained against outward flexure by the harness consisting of cables 24 and rollers 26 and their associated fixtures, and not primarily by the strength of the archer.

The free body diagram superimposed on FIG. 4 is exemplary of the vector forces which operate upon roller 26. Vector $V_1$ is aligned with cable 24; vector $V_2$ is aligned with roller 26 (normal to limb 14); and vector $V_3$ is aligned with bowstring 46. As is also apparent from said free body diagram, according to the present invention the energy put into the bow by the force applied in drawing it, is largely captured and modulated by said harness of this invention while the bow is held in the fully drawn position-rather than in the bowstring held by the archer.

As will be evident to those skilled in the art, many variations and modifications can be made in carrying out the invention, so that it is not intended to limit the invention except as defined in the appended claims.

What is claimed is:

1. An archery bow for shooting arrows comprising: a handle section by which the archer holds said bow during aiming and shooting; a pair of elongated limbs each extending longitudinally away from said handle section; a pair of spaced limb tips located at the ends of said limbs farthest from said handle section; a bowstring associated with said tips in force exerting relationship to said limbs; a pair of rollers coupled to said bowstring and mounted for movement along said limbs; a pair of roller frames one carried on one of said rollers and straddling one of said limbs and the other carried on the other of said rollers and straddling the other of said limbs and said rollers having means connected to said bow limbs to permit rolling by said rollers along said bow limbs substantially the full length of said bow limbs during the drawing of said bowstring.

2. The archery bow of claim 1 wherein said interconnecting means between said frames includes an inextensible cable of a predetermined length and said bow limbs are curved relative to said handle section forming an arcuate shape defined by said handle section, said limbs and said limb tips and said cable being disposed in a chordal position across said bow between said roller frames.

3. The archery bow of claim 2 wherein said bowstring is affixed to said limb tips and is connected to said frames.

4. The archery bow of claim 1 wherein said interconnecting means include a pair of legs mounted between said limbs and said handle section and extending toward said bowstring, each of said legs carrying a connecting member which extends to the couples with one of said frames.

5. The archery bow of claim 4 wherein each of said limb tips includes a pulley and said bowstring is interposed between said frames and carried in operative relationship to said pulleys.

6. The archery bow of claim 5 wherein said bow includes a front surface facing the direction in which the arrow is shot and a rear surface facing the direction of said bowstring and said rear surface being concave said rollers engaging said front surface for movement thereacross as said bowstring is drawn from a rest position to a drawn limb-flexed position.

* * * * *

UNITED STATES PATENT AND TRADEMARK OFFICE

CERTIFICATE OF CORRECTION

PATENT NO. : 4,020,819

DATED : May 3, 1977

INVENTOR(S) : James Ronald Haines

It is certified that error appears in the above-identified patent and that said Letters Patent are hereby corrected as shown below:

Column 6, Line 23, CLAIM 4, "the" should be -- and --

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*